US010829271B1

(12) United States Patent
Bulla

(10) Patent No.: US 10,829,271 B1
(45) Date of Patent: Nov. 10, 2020

(54) REPLACEABLE JAR PACKAGE

(71) Applicant: APC Packaging, LLC., Fort Lauderdale, FL (US)

(72) Inventor: Robert John Bulla, Coral Springs, FL (US)

(73) Assignee: APC Packaging, LLC., Fort Lauderdale, FL (US)

( * ) Notice: Subject to any disclaimer, the term of this patent is extended or adjusted under 35 U.S.C. 154(b) by 0 days.

(21) Appl. No.: 16/804,529

(22) Filed: Feb. 28, 2020

Related U.S. Application Data

(60) Provisional application No. 62/936,804, filed on Nov. 18, 2019.

(51) Int. Cl.

| | |
|---|---|
| ***B65D 23/08*** | (2006.01) |
| ***A45D 40/00*** | (2006.01) |
| ***B65D 43/02*** | (2006.01) |
| *A45D 34/00* | (2006.01) |

(52) U.S. Cl.
CPC ..... *B65D 23/0885* (2013.01); *A45D 40/0068* (2013.01); *B65D 43/0212* (2013.01); *A45D 2034/005* (2013.01); *A45D 2200/05* (2013.01)

(58) Field of Classification Search
CPC ..... A45D 40/0068; A45D 2034/005; A45D 2200/05; B65D 23/0885; B65D 43/0212
USPC ..... 220/6, 23.89, 23.87; 215/12.1
See application file for complete search history.

(56) References Cited

U.S. PATENT DOCUMENTS

| | | | | |
|---|---|---|---|---|
| 2,076,549 | A * | 4/1937 | Conner | A45D 40/0068 215/6 |
| 2,076,551 | A * | 4/1937 | Conner | A45D 40/0068 215/12.1 |
| 3,156,279 | A * | 11/1964 | Grebowiec | A45D 40/0068 215/12.1 |
| 3,483,908 | A * | 12/1969 | Donovan | B65D 1/34 221/260 |
| 3,550,803 | A * | 12/1970 | Pelli | B65D 77/0493 215/12.1 |
| 8,627,987 | B2 * | 1/2014 | Pollack | B65D 83/0005 220/8 |
| 8,800,818 | B2 | 8/2014 | Greenberg | |
| 8,870,011 | B2 * | 10/2014 | Hammer | A45D 33/18 206/581 |
| 8,950,634 | B2 | 2/2015 | Boes et al. | |
| 9,370,233 | B2 | 6/2016 | Jung | |
| 10,071,850 | B2 | 9/2018 | Sugawara et al. | |

(Continued)

*Primary Examiner* — J. Gregory Pickett
*Assistant Examiner* — Niki M Eloshway
(74) *Attorney, Agent, or Firm* — Fleit Intellectual Property Law; Jon Gibbons

(57) ABSTRACT

A replaceable jar package includes a push-to-release button, an inner jar sized to fit within the outer jar, the outer jar having a threaded opening at its top and having an opening at its bottom, and having a pair stubs for holding the push-to-release button within the opening at the bottom of the outer jar. The outer jar cooperates with the inner jar to form a snap feature. The inner jar is secured to the outer jar when the snap feature is engaged. The inner jar can be removed from the outer jar when the snap feature becomes disengaged. The snap feature is disengaged by the push-to-release button moving in a direction from the bottom of the outer jar toward a top of the outer jar such that the push-to-release button moves the inner jar relative to the outer jar.

20 Claims, 11 Drawing Sheets

(56) References Cited

U.S. PATENT DOCUMENTS

| | | | | |
|---|---|---|---|---|
| 2003/0071040 | A1* | 4/2003 | Brodner | B65D 25/205 220/23.87 |
| 2007/0029226 | A1* | 2/2007 | Yuhara | A45D 33/006 206/581 |
| 2008/0011778 | A1 | 1/2008 | Ronsin et al. | |
| 2015/0230583 | A1* | 8/2015 | Maelstaf | A45D 40/18 220/23.87 |
| 2017/0127799 | A1* | 5/2017 | Chung | A45D 33/24 |
| 2017/0275060 | A1 | 9/2017 | Hui et al. | |
| 2018/0290161 | A1 | 10/2018 | Lee | |
| 2018/0361413 | A1 | 12/2018 | Ruan | |
| 2020/0085166 | A1* | 3/2020 | Salciarini | A45D 40/222 |

* cited by examiner

REPLACEABLE JAR PACKAGE

BACKGROUND

Field

This invention relates generally to jars, and more specifically to a replaceable jar package for holding and delivering a cosmetic.

Related Art

Jar packages for holding and delivering a cosmetic are well known. Jar packages that include an inner container and an outer container are well known. Jar packages that include a snap-fit joint, snap joint or snap feature, are well known.

One known jar package comprises a replaceable inner jar that includes a heat induction seal. However, this one known jar package lacks an anti-rotate lug.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
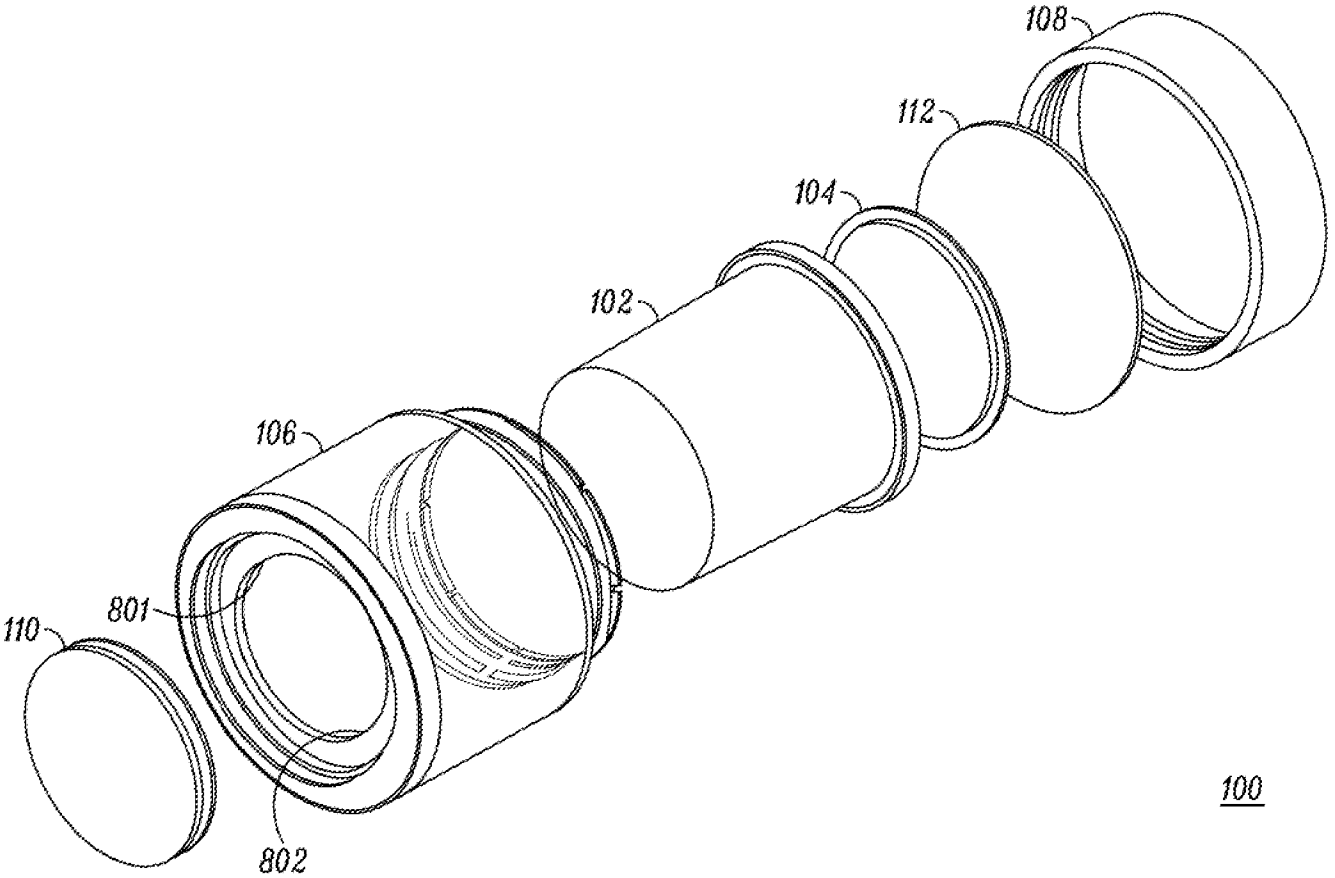
FIG. 1 is an exploded view of a replaceable jar package including an inner jar and a push-to-release button, in accordance with a first embodiment of the invention.

FIG. 1 is an exploded view of a replaceable jar package 100 comprising an inner jar 102 with a pull tab seal disk 104, an outer jar 106 with threads to accept a threaded cap 108, a push-to-release button (hereinafter "push button") 110 and a foam liner 112, in accordance with a first embodiment of the invention. Advantageously, the inner jar 102 is replaceable. The outer jar 106 cooperates with the inner jar 102 to form at least one snap feature. The inner jar 102 is secured to the outer jar 106 via the at least one snap feature.

Figures 2, 3:
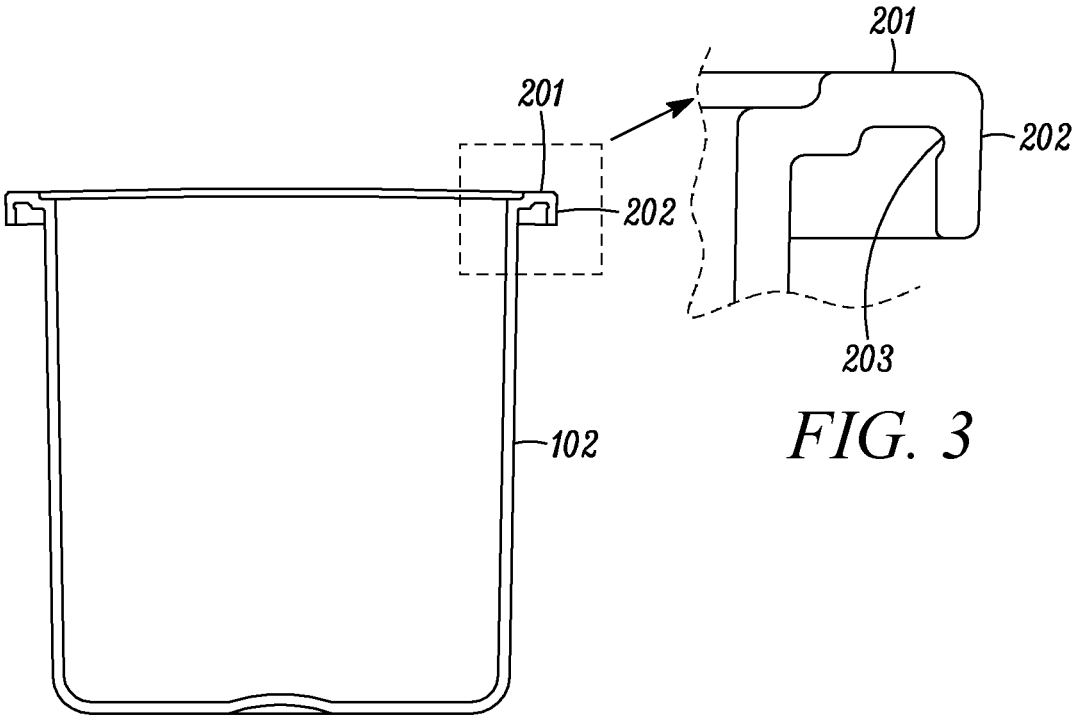
FIG. 2 is a cut-away view of the inner jar of FIG. 1 including a flange that extends completely around a rim of the inner jar and that includes a continuous undercut that forms part of a snap feature.
FIG. 3 is a view of a portion of FIG. 2 showing an enlargement of a portion of the rim of the inner jar.

FIG. 2 is a cut-away view of the inner jar 102 including a rim 201 at the top of the inner jar and a flange 202 that extends continuously and completely around the rim 201. The flange 202 includes a continuous undercut 203 that forms part of a snap feature. The continuous undercut 203 extends completely around and underneath the flange 202.

FIG. 3 is a view of a portion of FIG. 2 showing an enlargement of a portion of the rim 201.

Figures 4, 5:
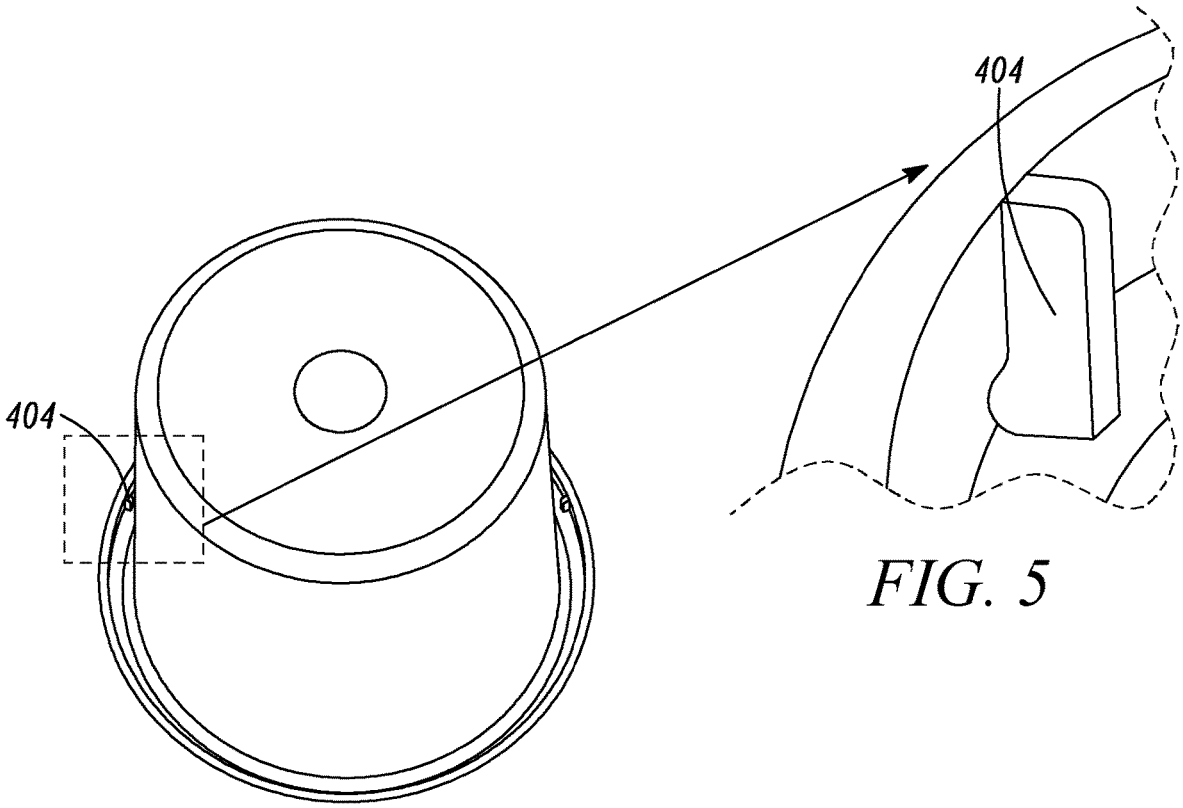
FIG. 4 is a perspective view of a bottom of the inner jar of FIG. 1 showing the rim at a top of the inner jar.
FIG. 5 is an enlarged view of a portion of FIG. 4 showing details of the rim of the inner jar including a stabilizing rib.

FIG. 4 is a perspective view of a bottom of the inner jar 102 showing the rim 201 at a top of the inner jar.

FIG. 5 is an enlarged perspective view of a portion of FIG. 4 showing details of the rim 201 including a stabilizing rib (hereinafter, "rib" 404). The inner jar 102 includes a plurality of ribs 404. In one embodiment, the inner jar 102 includes eight (8) ribs 404. We might want to give him other "embodiments where we show quick examples of 6 ribs, 4 ribs, 2 ribs, 1 rib, etc.

Figures 6, 7:
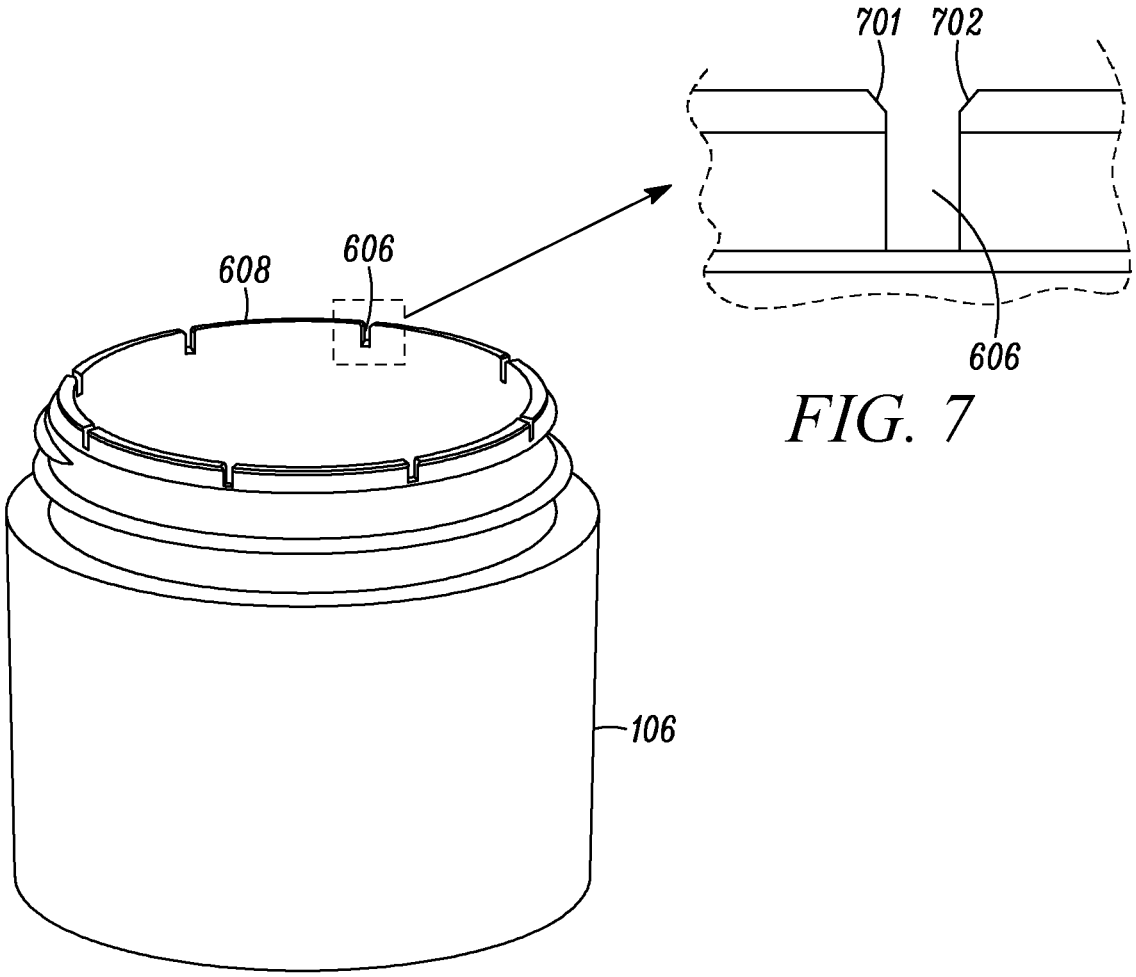
FIG. 6 is a perspective view of a side of the outer jar of FIG. 1 including a plurality of stabilizing notches at a top of the outer jar.
FIG. 7 is an enlarged view of a portion of FIG. 6 showing details of a stabilizing notch.

FIG. 6 is a perspective view of a side of the outer jar 106. The outer jar 106 includes a plurality of stabilizing notches, or slots 606, near a rim of the outer jar at the top of the outer jar. The slots are formed by material cut out from the outer jar 106. The material of the outer jar 106 between the slots 606 form annular snap beads 608. In one embodiment, the outer jar 106 includes eight (8) slots 606.

The annular snap beads 608 are evenly spaced around the diameter of the outer jar 106. The annular snap beads 608 at the top of the outer jar 106 cooperate with the undercut 203 underneath the rim 201 of the inner jar 102. Unlike the intermittent annular snap beads 608 on the outer jar 106, the undercut 203 of the inner jar 102 is continuous because there are no cut outs on the rim 201 of the inner jar. Moreover, because there are no cut outs on the rim 201 of the inner jar, hoop stress applied on the inner jar 102 when the replaceable jar package 100 is assembled is advantageously dispersed radially.

FIG. 7 is an enlarged view of a portion of FIG. 6 showing details of one slot 606. The material of the outer jar 106 at the top of each slot 606 is cut out at angles 701 and 702 so that corresponding ribs 404 on the inner jar 102 can easily align with each slot. The slots 606 at the top of the outer jar 106 are mated with the ribs 404 on the inner jar 102. The ribs 404 and the slots 606 are designed to stabilize the inner jar 102 securely so when the threaded cap 108 is applied and the correct application torque has been achieved the inner jar does not skew to one side due to the threaded cap wanting to push on one side of the inner jar with more force than on the other side. The slots 606 also act as anti-rotate lugs so the inner jar 102 does not spin inside the outer jar 106.

Figures 8, 9:
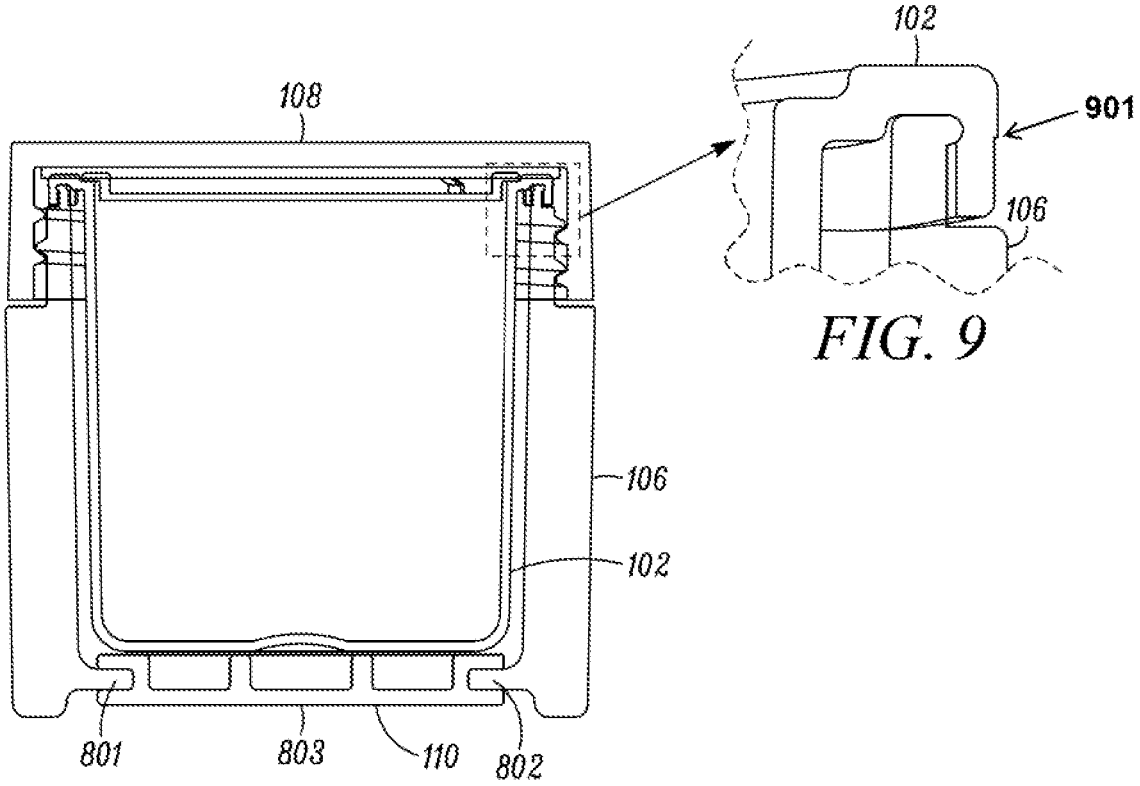
FIG. 8 is a cut-way view of the replaceable jar package of FIG. 1 showing the push-to-release button in state of not pushed, and showing the snap feature engaged.
FIG. 9 is an enlarged view of a portion of FIG. 8 showing details of the engaged snap feature.

FIG. 8 is a cut-way view of the replaceable jar package 100 showing the push button 110 in state of not pushed, and showing the snap feature engaged. FIG. 8 shows the threaded cap 108 screwed on to the outer jar 106.

The replaceable jar package 100 includes a mechanism for securing the inner jar 102 to the outer jar 106 and the mechanism includes a release mechanism. The securing mechanism includes the snap features. The release mechanism includes the push button 110. The push button 110 may vary in shape, size and location. The outer jar 106 includes a circular inner lip that appears as a pair of stubs 801 and 802 for holding the push button 110 within the opening at the bottom of the outer jar. The one embodiment, the push button 110 is flexible or pliable. Such a pliable push button 110 comprises one of a thermoplastic elastomer material, a thermoplastic polyurethane material, a silicone material, a thermoplastic rubber material, a thermoplastic urethane material, or another type of thermoset material. Actuation of the pliable push button 110 is accomplished via a direct force applied to a center 803 of the push button, which disengages the at least one snap feature to release the inner jar 102 from the outer jar 106. The inner jar 102 can be removed from the outer jar 106 by using the pliable push button 110 that, when pressed by a user, will disengage the snap bead 608. Advantageously, because of the presence of the push button 110 at a bottom of the replaceable jar package, the first embodiment of the replaceable jar package 100 has a closed-bottom appearance. In another embodiment (not shown) of the replaceable jar package 100, the push button 110 is rigid.

FIG. 9 is an enlarged view of a portion of FIG. 8 showing details of the snap feature 901 engaged.

Figure 10:
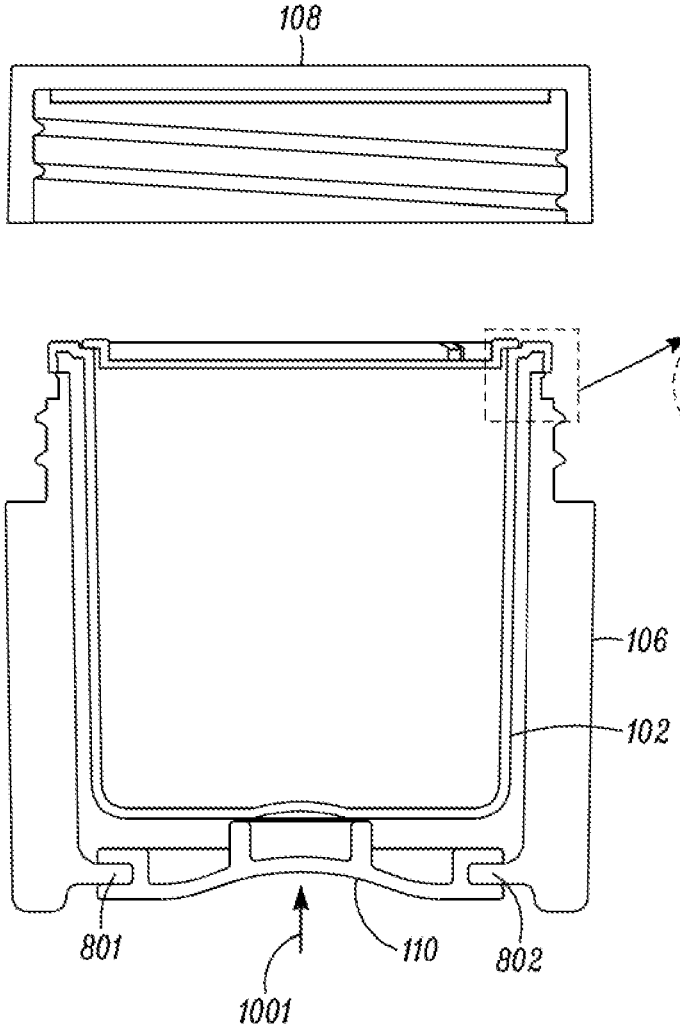
FIG. 10 is a cut-way view of the replaceable jar package of FIG. 1 showing the push-to-release button in state of pushed, and showing the snap feature disengaged.

FIG. 10 is a cut-way view of the replaceable jar package 100 showing the push button 110 in state of pushed, and showing the snap feature disengaged. FIG. 10 shows the threaded cap 108 not screwed on to the outer jar 106. FIG. 10 shows the pliable push button 110 being actuated via a direct force applied to a center 803 of the push button, as indicated by arrow 1001, which disengages the at least one snap feature to release the inner jar 102 from the outer jar 106.

Figure 11:
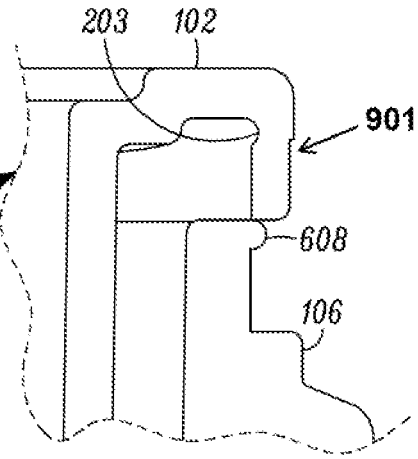
FIG. 11 is an enlarged view of a portion of FIG. 10 showing details of the disengaged snap feature.

FIG. 11 is an enlarged view of a portion of FIG. 10 showing details of the snap feature 901 disengaged.

A consumer, or user, places the inner jar 102 into the outer jar 106 after an original inner jar has been removed from the outer jar. However, there are no threads on the inner jar 102 (which could have been used in conjunction with the threads on the threaded cap 108 if such threads were present on the inner jar) to properly seal the inner jar. Therefore, the threaded cap 108 is turned by the user such that the threads on the outer jar 106 and the threads on the threaded cap 108 are properly torqued to indirectly seal the inner jar 102.

The inner jar 102 is designed with the at least one snap bead 608 that holds the inner jar in place even when the inner jar is filled and the replaceable jar package 100 is turned upside down and shook.

Figure 12:
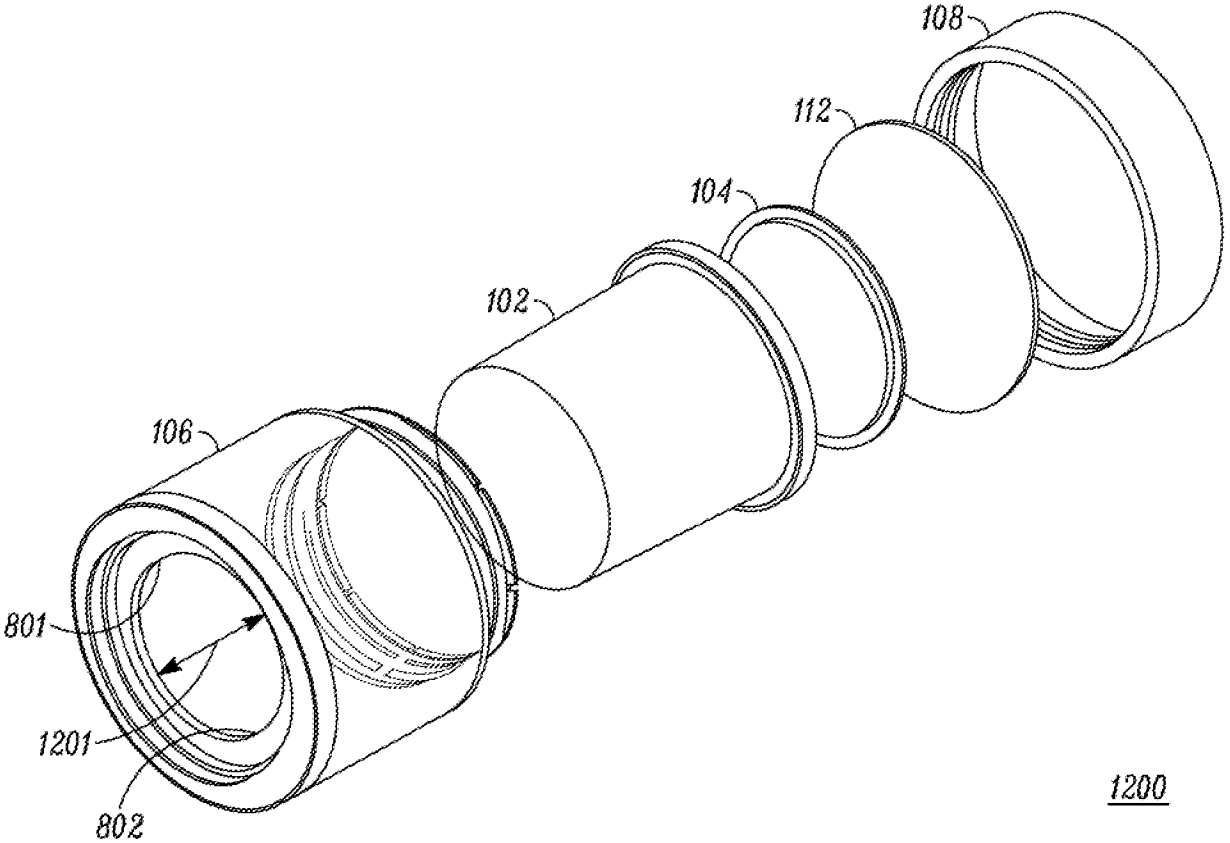
FIG. 12 is an exploded view of a replaceable jar package including an inner jar, in accordance with a second embodiment of the invention.

FIG. 12 is an exploded view of a replaceable jar package 1200 including the inner jar 102 with the pull tab seal disk 104, the outer jar 106 with threads to accept the threaded cap 108, and the foam liner 112, in accordance with a second embodiment of the invention. The outer jar 106 has an opening 1201 at its bottom. The replaceable jar package 1200 includes a mechanism for securing the inner jar 102 to the outer jar 106 and the mechanism includes a release mechanism. The securing mechanism includes the snap features. The second embodiment of the replaceable jar package 1200 does not include a push-to-release button. With the second embodiment of the replaceable jar package 1200, the inner jar 102 can be removed from the outer jar 106 by the user simply applying sufficient pressure directly to the inner jar so as to disengage the snap feature of the replaceable jar package.

Figures 13, 14:
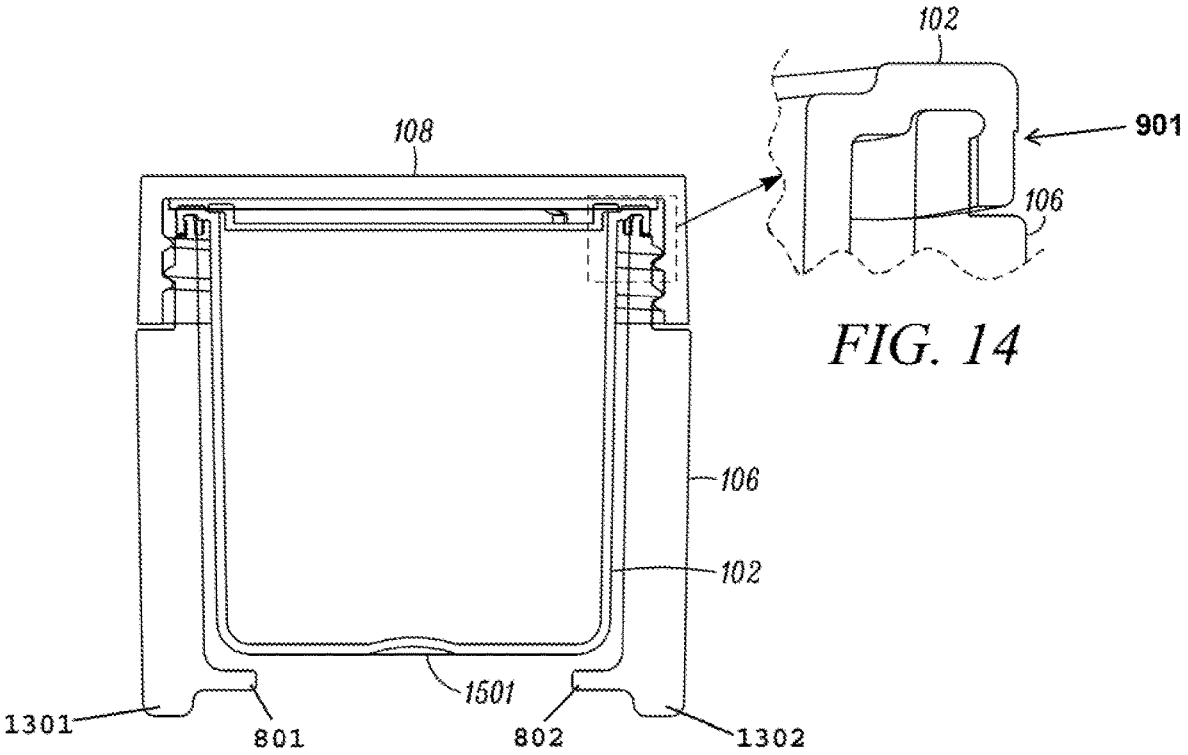
FIG. 13 is a cut-way view of the replaceable jar package of FIG. 12 showing a snap feature engaged.
FIG. 14 is an enlarged view of a portion of FIG. 13 showing details of the engaged snap feature.

FIG. 13 is a cut-way view of the replaceable jar package 1200 showing a left side 1301 and a right side 1302 of a circular foot, and the snap feature 901 engaged. FIG. 13 shows the threaded cap 108 screwed on to the outer jar 106.

FIG. 14 is an enlarged view of a portion of FIG. 13 showing details of the engaged snap feature.

Figures 15, 16:
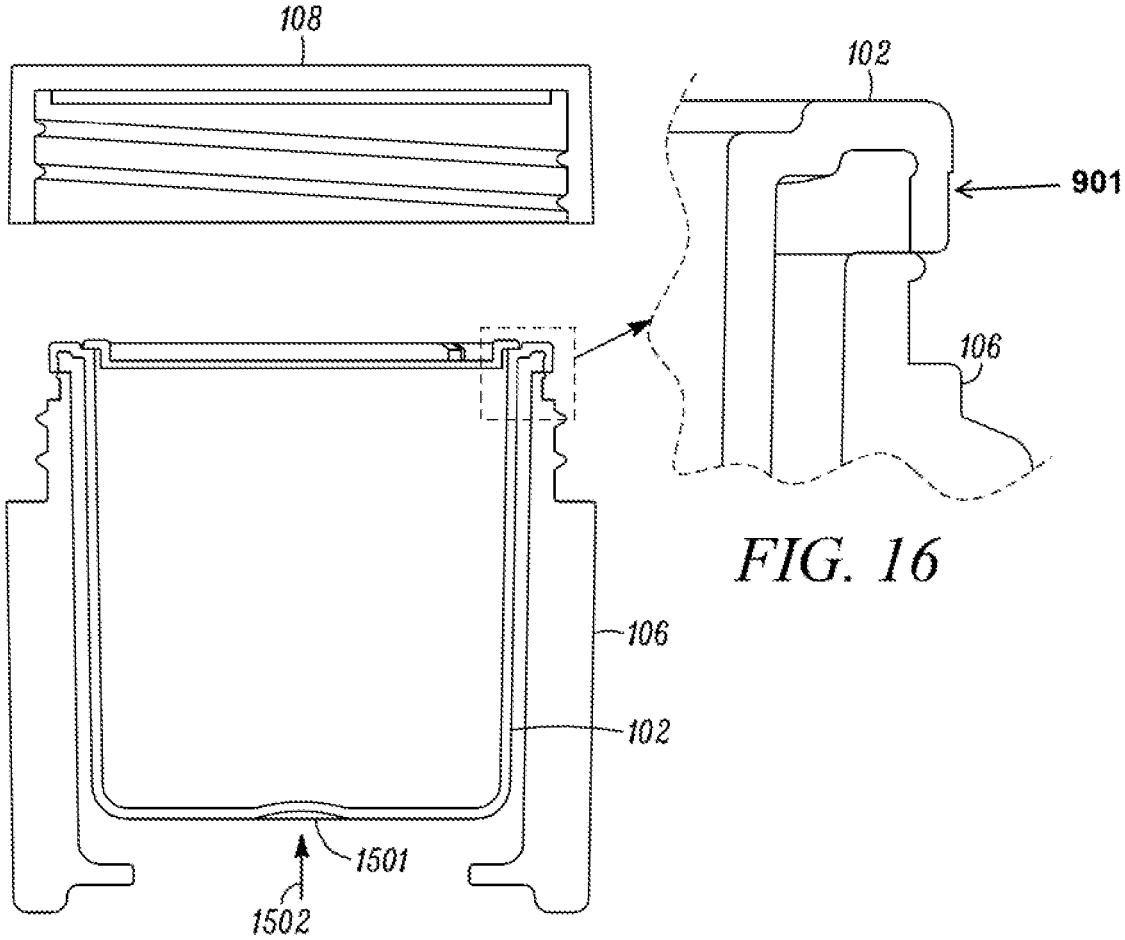
FIG. 15 is a cut-way view of the replaceable jar package of FIG. 12 showing a snap feature disengaged.
FIG. 16 is an enlarged view of a portion of FIG. 15 showing details of the disengaged snap feature.

FIG. 15 is a cut-way view of the replaceable jar package 1200 showing a snap feature disengaged. FIG. 15 shows the threaded cap 108 not screwed on to the outer jar 106. The inner jar 102 is removed from the outer jar 106 by the user simply applying sufficient pressure directly to a bottom 1501 of the inner jar, as indicated by the arrow 1502.

FIG. 16 is an enlarged view of a portion of FIG. 15 showing details of the disengaged snap feature.

Figure 17:
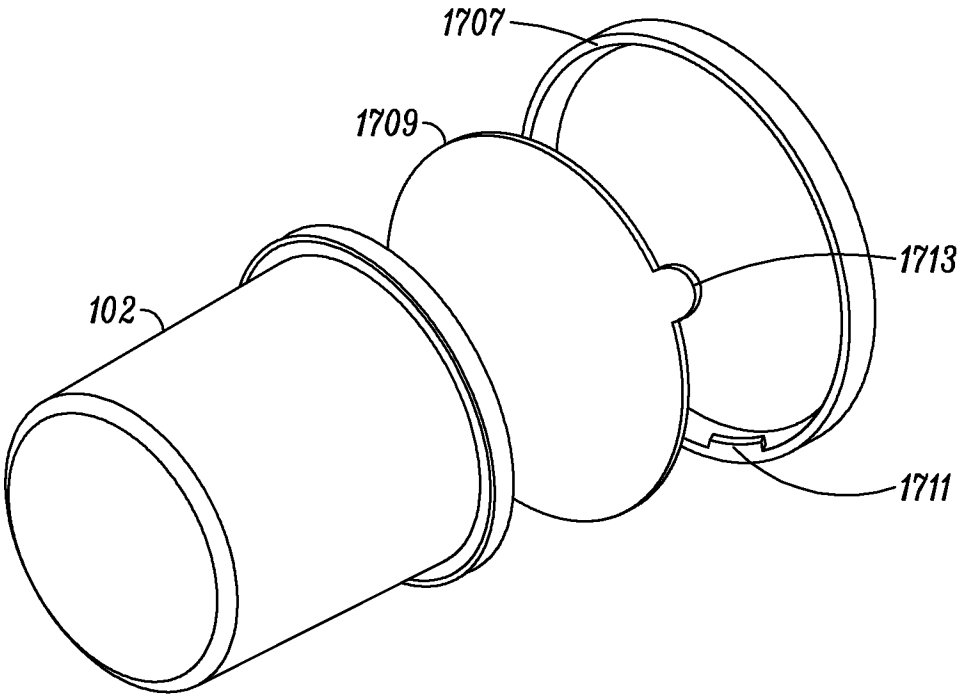
FIG. 17 is an exploded view of an inner jar, a snap-on service cap and an induction liner.

FIG. 17 is an exploded view of the inner jar 102, a snap-on service cap (hereinafter "service cap") 1707 and a heat induction liner (hereinafter "induction liner") 1709. The inner jar 102 can be used with or without the service cap 1707. The service cap 1707 is designed to hold the induction liner 1709 in place and to apply the correct amount of pressure for proper lining. The service cap 1707 is also designed to be an extension of the inner jar 102 from a marketing standpoint and can have logos applied through emboss or deboss or other decoration such as silk screen or hot stamping to elevate the appearance of the replaceable jar package 100 and 1200.

Figure 18:
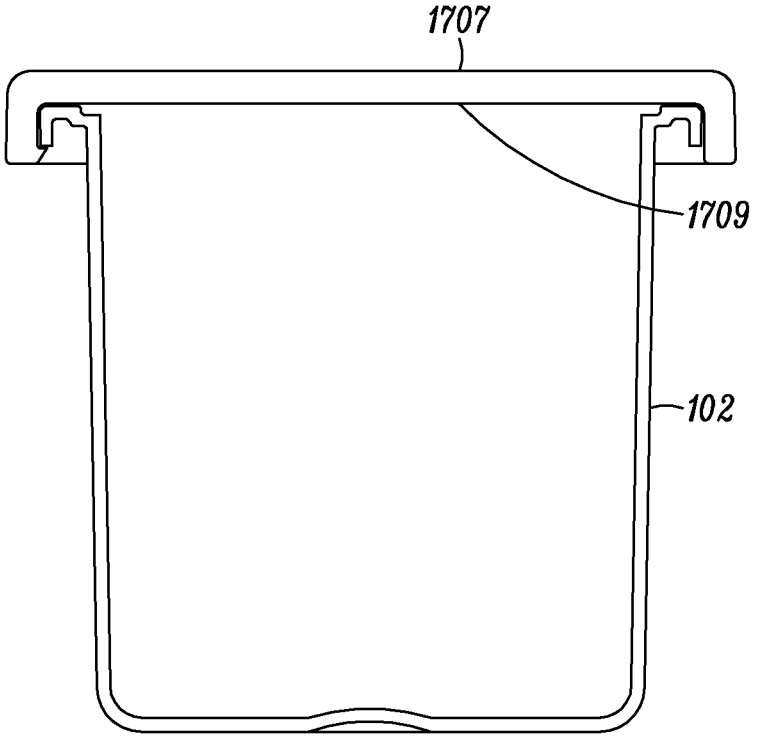
FIG. 18 is a cut-away view of the inner jar, the snap-on service cap and the induction liner.

FIG. 18 is a cut-away view of the inner jar 102, the service cap 1707 and the induction liner 1709. The service cap 1707 is used in the manufacturing process to apply the induction liner 1709 to the inner jar 102. The service cap 1707 is designed to hold the induction liner 1709 in place and apply the correct amount of pressure for proper lining. In the illustrated embodiment, the service cap 1707 has three (3) annular snap beads 1711 around its inside wall so that it applies equal pressure distribution to the induction liner 1709 on the inner jar 102. The size, shape and location of the snap features may vary as long as they provide enough securement for the heat induction lining process. The inner jar 102 is them put in an energized state, which activates an adhesive on the induction liner 1709, and causes it to adhere to the inner jar 102. Then, the service cap 1707 would either be reused or disposed of by the factory.

The inner jar 102 is designed so that, after removal of the heat induction liner 1709 by pulling on a pull tab 1713, the inner jar becomes an open container and has no means of being re-sealed without using the outer jar 106 and properly torqueing the threaded cap 108. After the heat induction liner 1709 is removed, the service cap 1707 does not provide air tight seal and the contents of the inner jar 102 may dry or evaporate if the inner jar is not put back into the outer jar 106 with the threaded cap 108 closed with the foam liner 112.

The inner jar 102 may, for example, hold lotions, creams, serums or moisturizers for the beauty industry. However, the inner jar 102 may also hold substances for non-beauty industries.

The outer jar 106 is designed to use multiple materials by having a wall thickness that is conducive to bottle grade polyethylene terephthalate. The replaceable jar package 100 and 1200 is made from polypropylene terephthalate with the recycle code of "5" which can be made at varying levels of post-consumer recycled polypropylene. A purpose of the replaceable jar package 100 and 1200 is to increase sustainability of packages in the cosmetic industry. The material of the inner jar 102 and the outer jar 106 may include less than 1% of a thermoplastic elastomer. The thermoplastic elastomer improves impact properties of polypropylene.

The user friendliness of the replaceable jar package 100 and 1200 is attributed to the ease of removal of the inner jar 102 via actuation of the push button 110 by an optimal release force. The amount of release force needed to disengage the snap feature is the range of 1 to 8 inch-pounds.

The inner jar 102 easily rotates but advantageously does not warp to one side due to the use of the ribs 404 in the inner jar 102 and the slots 606 in the outer jar 106.

In one embodiment, a size of the opening 1201 at the bottom of the outer jar 106 is big enough for a label, such as a pressure-sensitive label, that had been placed on the bottom of the inner jar 102 to be read by a consumer or user. In another embodiment (not shown), the size of the opening 1201 at the bottom of the outer jar 106 is smaller, but large enough for a user to access the bottom of the inner jar 102.

Snap features may vary in number of snap features, shape, size and location on the replaceable jar package 100 and 1200. In some embodiments, the at least one snap feature is an annular snap joint. In other embodiments, the at least one snap feature is a cantilever snap joint.

The terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The Detailed Description section, and not the Abstract section, is intended to be used to interpret the claims. The Abstract section may set forth one or more but not all embodiments of the invention, and the Abstract section is not intended to limit the invention or the claims in any way.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages or solutions to problems that are described herein with regard to specific embodiments are not intended to be construed as a critical, required, or essential feature or element of any or all the claims.

I claim:

1. A replaceable jar package, comprising:

an outer jar having a plurality of stabilizing slots, the outer jar having a circular opening at its bottom;

a circular foot at a bottom of the outer jar;

a threaded cap for covering the outer jar; and an inner jar sized to fit within the outer jar, the inner jar having a plurality of stabilizing ribs, wherein the outer jar cooperates with the inner jar to form at least one snap feature, wherein the inner jar is secured to the outer jar when the at least one snap feature is engaged, and wherein the inner jar can be removed from the outer jar when the at least one snap feature becomes disengaged, and wherein the outer jar includes threads near its top, and wherein the plurality of stabilizing slots and the plurality of stabilizing ribs hold the inner jar securely when the threaded cap is applied to the outer jar, such that, when a correct application torque has been achieved, the inner jar does not skew to one side, wherein the outer jar includes a circular inner lip that is co-planar with the circular opening such that the circular opening has a diameter less than a diameter of the inner jar, wherein the circular opening is sized such that a user can make contact with the inner jar through the circular opening to disengage the snap feature securing the inner jar to the outer jar, wherein the circular inner lip is distal from the bottom of the outer jar by a height of the circular foot, and wherein the outer jar, the circular inner lip and the circular foot are formed as one unitary structure.

2. The replaceable jar package of claim 1, wherein the user disengages the at least one snap feature by moving the inner jar in a direction toward a top of the outer jar.

3. The replaceable jar package of claim 1, wherein the at least one snap feature is located near a top of the outer jar.

4. The replaceable jar package of claim 1, wherein the at least one snap feature is located near a top of the inner jar.

5. The replaceable jar package of claim 1, wherein the at least one snap feature is located near a top of the replaceable jar package.

6. The replaceable jar package of claim 1, wherein the replaceable jar package includes a snap feature only near a top of the replacement jar package.

7. A replaceable jar package, comprising:

a push-to-release button;

an outer jar having a threaded opening at its top and having an opening at its bottom, and having a circular inner rim for holding the push-to-release button within the opening at the bottom of the outer jar;

a plurality of annular snap beads near a rim of the outer jar at the top of the outer jar, each annular snap bead forming part of a snap feature;

an inner jar having a closed bottom and an opening at its top, the inner jar having a diameter smaller than a diameter of the outer jar, the inner jar having a height smaller than a height of the outer jar such that the inner jar can fit into the outer jar; and a rim at the top of the inner jar, the rim having a flange that extends completely around the inner jar, wherein the flange has an undercut that forms part of the snap feature, wherein, when the snap feature is engaged, the inner jar remains securely in the outer jar, and wherein, when the snap feature is disengaged, the inner jar can be removed from inside the outer jar.

8. The replaceable jar package of claim 7, wherein the push-to-release button is pliable.

9. The replaceable jar package of claim 8, wherein a center portion of the push-to-release button is movable between a first position wherein center portion does not contact the closed bottom of the inner jar and a second position wherein the center portion does contact the closed bottom of the inner jar.

10. The replaceable jar package of claim 9, wherein the snap feature is disengaged by a user moving the push-to-release button in a direction from the bottom of the outer jar toward the top of the outer jar such that the center portion of the push-to-release button moves the inner jar relative to the outer jar.

11. The replaceable jar package of claim 8, wherein the outer jar has a plurality of stabilizing slots.

12. The replaceable jar package of claim 11, wherein the inner jar has a plurality of stabilizing ribs.

13. The replaceable jar package of claim 12, wherein the plurality of stabilizing slots and the plurality of stabilizing ribs cooperate together to prevent the inner jar from spinning inside the outer jar when a threaded cap is applied to the outer jar.

14. The replaceable jar package of claim 12, including a threaded cap, wherein the plurality of stabilizing slots and the plurality of stabilizing ribs cooperate together to hold the inner jar securely when a threaded cap is applied to the outer jar, such that, when a correct application torque has been achieved, the inner jar does not skew to one side.

15. A replaceable jar package, comprising:

an outer jar having a threaded opening at its top and having a circular inner lip at its bottom, the circular inner lip defining a circular opening at the bottom of the outer jar;

a circular foot at the bottom of the outer jar;

a plurality of annular snap beads near a rim of the outer jar at the top of the outer jar, each annular snap bead forming part of a snap feature;

an inner jar having a closed bottom and an opening at its top, the inner jar having a diameter smaller than a diameter of the outer jar, the inner jar having a height smaller than a height of the outer jar such that the inner jar can fit into the outer jar; and a rim at the top of the inner jar, the rim having a flange that extends completely around the inner jar, wherein the flange has an undercut that forms part of the snap feature, wherein, when the snap feature is engaged, the inner jar remains securely in the outer jar, wherein, when the snap feature is disengaged, the inner jar can be removed from inside the outer jar, wherein the circular opening has a diameter less than a diameter of the inner jar, wherein the circular opening is sized such that the inner jar is accessible by a user through the circular opening, wherein the circular inner lip is distal from the bottom of the outer jar by a height of the circular foot, and wherein the outer jar, the circular inner lip and the circular foot are formed as one unitary structure.

16. The replaceable jar package of claim 15, wherein the snap feature is disengaged by the user moving the inner jar in a direction from the bottom of the outer jar toward a top of the outer jar.

17. The replaceable jar package of claim 15, wherein the outer jar has a plurality of stabilizing slots.

18. The replaceable jar package of claim 17, wherein the inner jar has a plurality of stabilizing ribs.

19. The replaceable jar package of claim 18, wherein the plurality of stabilizing slots and the plurality of stabilizing ribs cooperate together to prevent the inner jar from spinning inside the outer jar when a threaded cap is applied to the outer jar.

20. The replaceable jar package of claim 18, including a threaded cap, wherein the plurality of stabilizing slots and the plurality of stabilizing ribs cooperate together to hold the inner jar securely when a threaded cap is applied to the outer jar, such that, when a correct application torque has been achieved, the inner jar does not skew to one side.

* * * * *